US008484913B2

(12) United States Patent
Charbonneau

(10) Patent No.: US 8,484,913 B2
(45) Date of Patent: Jul. 16, 2013

(54) JAMB AND FRAME COMBINATION FOR DOORS AND WINDOWS

(76) Inventor: Pierre Charbonneau, St-Sauveur (CA)

( * ) Notice: Subject to any disclaimer, the term of this patent is extended or adjusted under 35 U.S.C. 154(b) by 0 days.

(21) Appl. No.: 13/198,673

(22) Filed: Aug. 4, 2011

(65) Prior Publication Data

US 2012/0031021 A1 Feb. 9, 2012

(30) Foreign Application Priority Data

Aug. 4, 2010 (GB) ..... 1013113.4

(51) Int. Cl.
*E06B 1/04* (2006.01)

(52) U.S. Cl.
USPC ..... 52/210; 52/212; 52/213

(58) Field of Classification Search
USPC ..... 52/210–216
See application file for complete search history.

(56) References Cited

U.S. PATENT DOCUMENTS

| | | | | |
|---|---|---|---|---|
| 403,573 | A | 5/1889 | Boda | |
| 990,209 | A * | 4/1911 | MacKenzie | 411/461 |
| 1,926,673 | A * | 9/1933 | Gregg | 52/211 |
| 2,736,930 | A | 3/1956 | Longley | |
| 2,742,146 | A | 4/1956 | Lester, Jr. | |
| 3,040,390 | A | 6/1962 | Carlton | |
| 3,320,705 | A * | 5/1967 | Downing, Jr. | 52/214 |
| 3,570,202 | A | 3/1971 | Castellano | |
| 3,757,473 | A | 9/1973 | Mundy | |
| 4,509,294 | A | 4/1985 | Boilard | |
| 6,148,883 | A | 11/2000 | Wilson | |
| 6,178,717 | B1 * | 1/2001 | Loop | 52/714 |
| 6,405,501 | B1 * | 6/2002 | Cerrato | 52/217 |
| 6,588,159 | B1 * | 7/2003 | Cotton, Jr. | 52/211 |
| 7,921,603 | B2 * | 4/2011 | Darnell | 49/504 |

* cited by examiner

*Primary Examiner* — William Gilbert
*Assistant Examiner* — Gisele Ford

(57) ABSTRACT

A jamb and frame combination for doors and windows having an elongated L-shaped cross section member adapted to fit snugly against two abutting side portions of a window or door casing, and including a tongue portion along one distal side portion and extending the length thereof, and at least one removable fastener adapted to pass through the L-shaped cross section member in an area adjacent to the tongue portion and into the window or door casing to thereby hold the L-shaped cross section member snugly thereto. An elongated trim member including a groove portion extending the length thereof and adapted to interlock with the tongue portion of the L-shaped cross section member, such that when the L-shaped cross section member is installed upon a window or door casing, the trim member groove portion can be pushed upon the L-shaped cross section member tongue portion and frictionally held in place and covering the at least one removable fastener.

4 Claims, 5 Drawing Sheets

12"
42
26
20
28

JAMB AND FRAME COMBINATION FOR DOORS AND WINDOWS

This application claims priority based on request GB1013113.4 filed Aug. 4, 2010

FIELD OF THE INVENTION

The present invention relates generally to construction but more particularly to jambs and frames for doors and windows.

BACKGROUND OF THE INVENTION

Installing doors involve arranging for an opening in a wall wherein stud define a casing into which fit the door jamb. The door jamb is what holds a door by way of hinges. In order to conceal the spacing between the casing and the jamb, a door frame overlaps that section and acts as a decorative element for the door. The same applies of course to windows. Typically, jambs and frames are separate pieces that require varying degrees of cutting and adjustments. It is that cutting and adjustment that is time consuming and can also be badly done according to the ability of whoever does the work.

SUMMARY OF THE INVENTION

In view of the foregoing disadvantages inherent in the known devices now present in the prior art, the present invention, which will be described subsequently in greater detail, is to provide objects and advantages which are:

To provide for an integrated system of jambs and frame which can also be applied to windows.

Another advantage of this invention is to make it easier and faster to install doors or windows.

Another advantage is to have easily removable edges which allow for the painting of walls without using masking tape since when the trim is put back, the paint line is hidden.

Another advantage is to have the finishing, paint, stain, lacquer in the manufacturing plant to have exacting quality standards.

There are two possible variations, one being that the frames are used for securing the jambs so that the jambs do not need to be nailed to the casing. The frame requires strong large screws to secure the jamb and the frame onto the casing. The screws are then hidden by a trim.

The second variation truly has a monolithic jamb and frame in a "U" shape configuration, which is in fact the way the first variant looks like once assembled, wherein small trims also hide the large screws needed to secure the whole.

The combination of frame and trims is also applied around windows or even to make baseboards.

In order to do so, the invention comprises an elongated L-shaped cross section member adapted to fit snugly against two abutting side portions of a window or door casing, and including a tongue portion along one distal side portion and extending the length thereof, and at least one removable fastener adapted to pass through the L-shaped cross section member in an area adjacent to the tongue portion and into the window or door casing to thereby hold the L-shaped cross section member snugly thereto. An elongated trim member including a groove portion extending the length thereof and adapted to interlock with the tongue portion of the L-shaped cross section member, such that when the L-shaped cross section member is installed upon a window or door casing, the trim member groove portion can be pushed upon the L-shaped cross section member tongue portion and frictionally held in place and covering the at least one removable fastener.

Once assembled the work is done because all of the finishing (paint, stain, lacquer) has been done at the manufacturing plant and the contractor has finished his job which saves a lot of time and hassle.

At least one removable fastener includes a series of removable fasteners extending the length of the L-shaped cross section member.

The L-shaped cross section member and the trim member have interdigitating shapes, such that the trim member fits snugly around the tongue portion and a front surface of the L-shaped cross section member, and thereby covering the at least one removable fastener.

In a jamb and frame combination for window or door casings, comprising an elongated jamb member adapted to fit snugly against the interior surface of a window or door casing, and having a tongue portion on each opposite side extending the length thereof. A first frame member adapted to fit snugly against a respective inner or outer surface of the window or door casing, wherein the first frame member includes a groove portion extending the length thereof on one distal end that is adapted to snugly receive and mate with a respective tongue portion of the jamb member, and includes a tongue portion extending the lengths thereof on an opposite distal end that is adapted to snugly receive and mate with a respective grooves of a trim member, and at least one removable fastener adapted to pass through the respective frame member in an area adjacent to each the tongue portion and into the window or door casing to thereby hold the first frame member snugly thereto.

An elongated first trim member including a groove portion extending the length thereof and adapted to interlock with the tongue portion of the first frame member, such that when the first frame members is installed upon a window or door casing, the first trim member groove portion can be pushed upon the first frame member tongue portion and frictionally held in place and covering the at least one removable fastener. A second frame member adapted to fit snugly against a an opposite inner or outer surface of the window or door casing, wherein the second frame member includes a groove portion extending the length thereof on one distal end that is adapted to snugly receive and mate with the opposite respective tongue portion of the jamb member, and includes a second groove portion extending the length thereof on an outside surface, and at least one removable fastener adapted to pass through the second frame member at a point that is within the second groove portion and into the window or door casing to thereby hold the second frame member snugly thereto. And an elongated second trim member adapted to snugly fit within and cover the second groove portion and the at least one removable fastener.

The combination wherein each of the at least one removable fasteners for each respective frame member includes a series of removable fasteners extending the length of each the respective frame member.

The first frame member and the first trim member have interdigitating shapes, such that the first trim member fits snugly around the tongue portion and a front surface of the first frame member, thereby covering the at least one removable fastener.

The second trim member includes two deformable arms extending the length thereof, and are adapted to be pushed into and deformed within the second groove portion to thereby create a strong friction hold between the second trim member and the second groove portion.

The jamb member and the first and second frame members are pre-formed together as one solid U-shaped member adapted to fit snugly upon and around the inner, outer, and interior surfaces of a chosen window or door casing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention.

DETAILED DESCRIPTION OF THE PREFERRED EMBODIMENT

Figure 1:
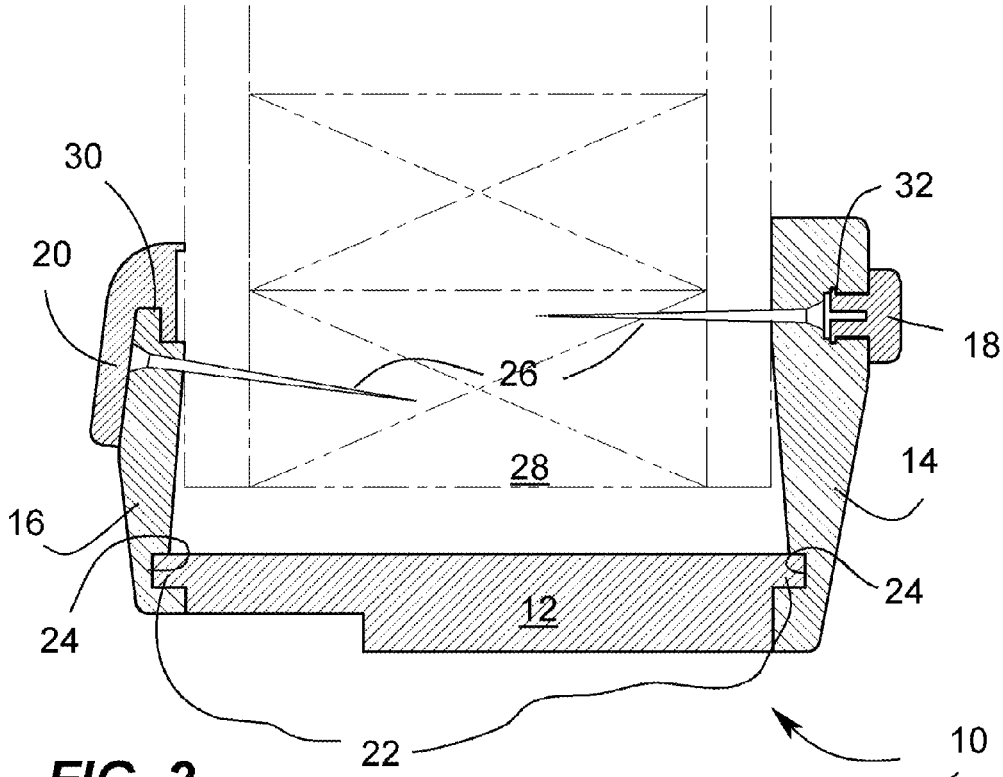
FIGS. 1-2 Cutaway top views of two embodiments of the invention.
Figure 2:
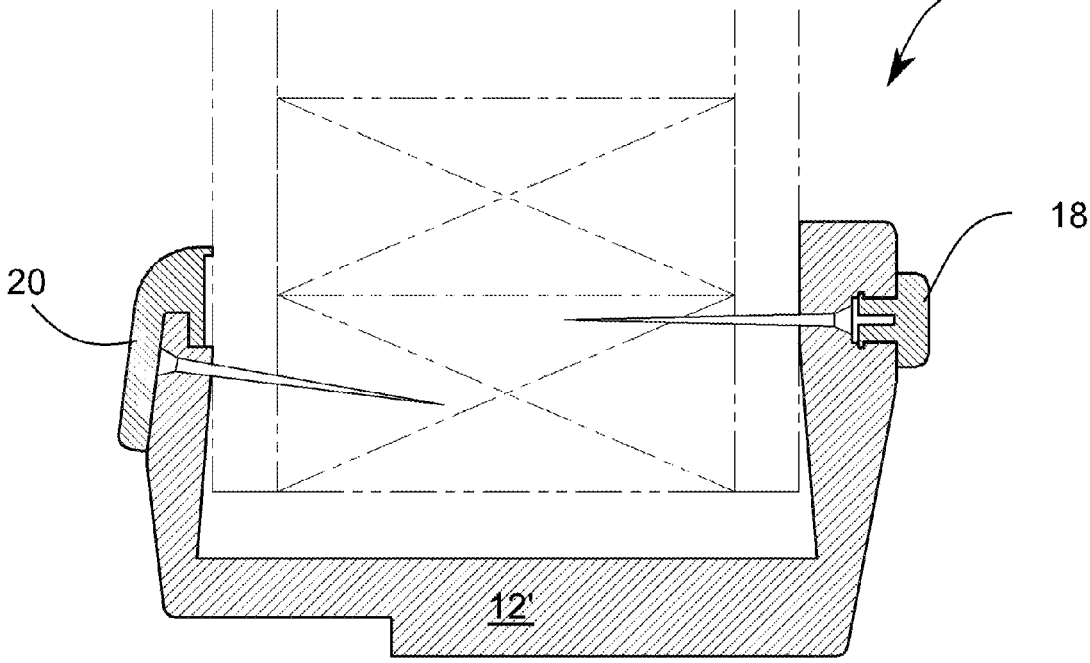
Figure 3B:
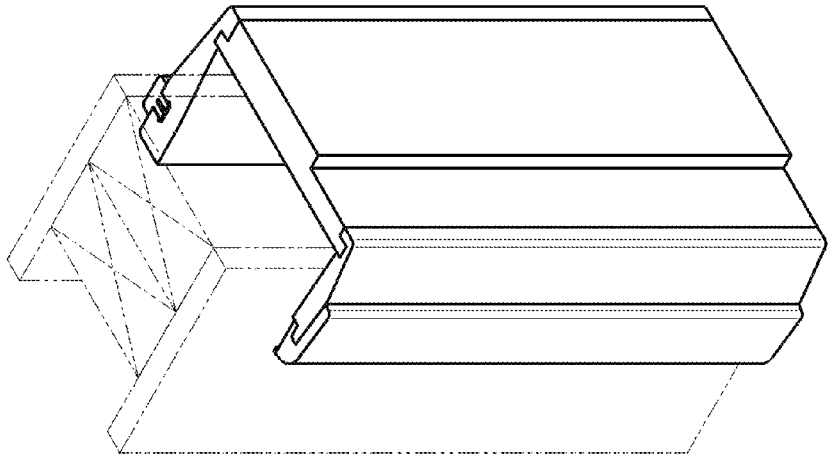
FIGS. 3*a-b* Exploded view and isometric view, respectively, of the invention.
Figure 3A:
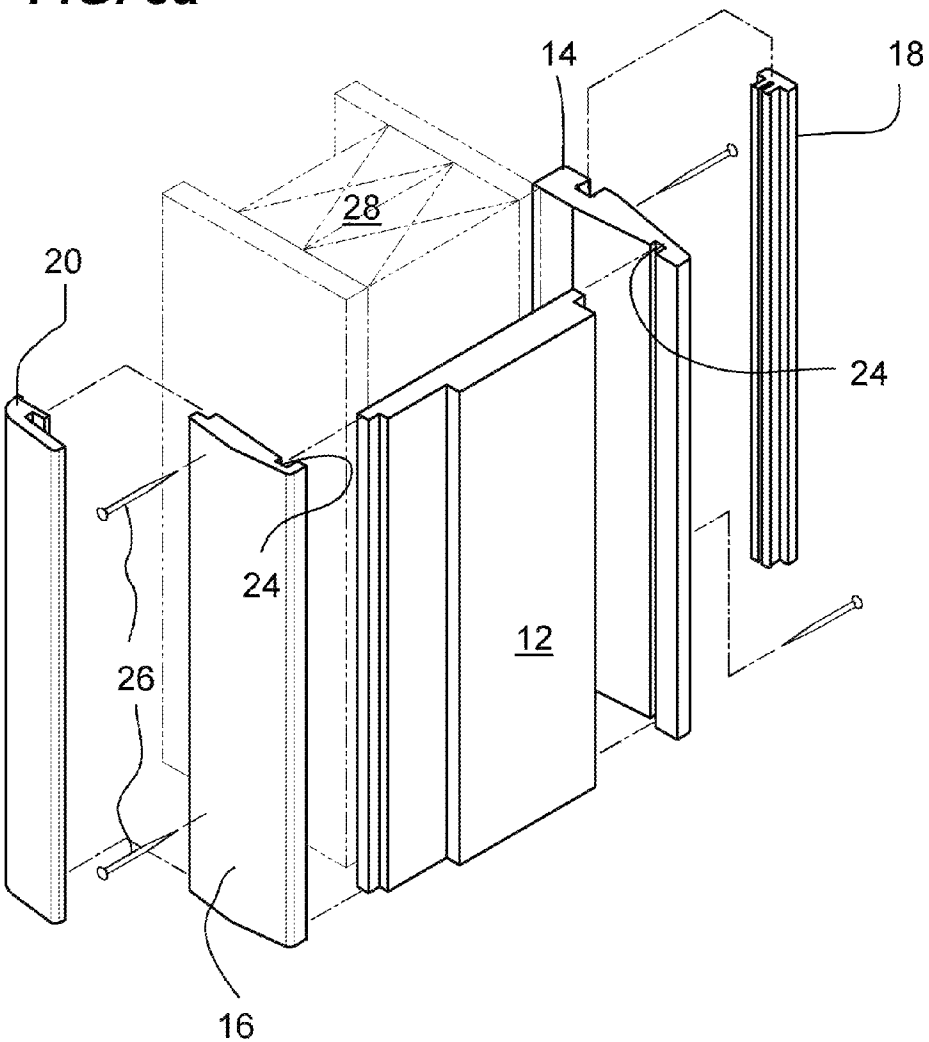
Figure 4B:
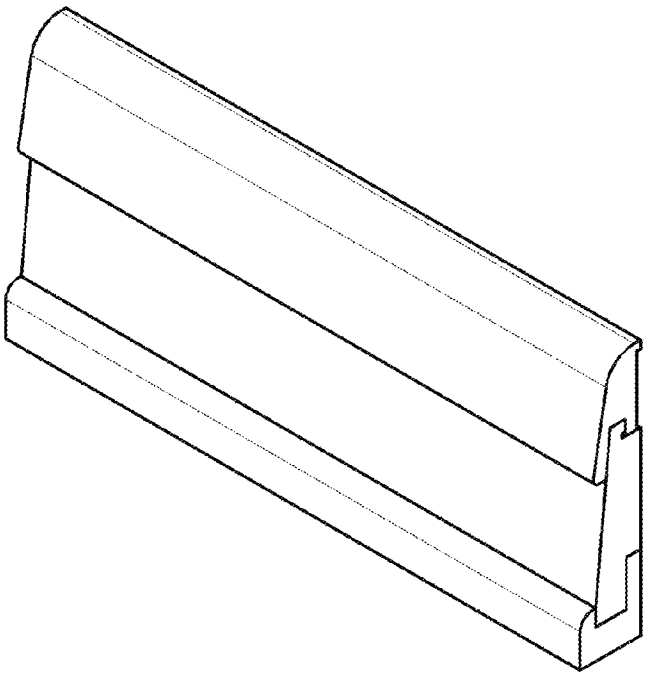
FIGS. 4*a-b* Exploded view and isometric view, respectively, of the a baseboard variant using the same construction principles.
Figure 4A:
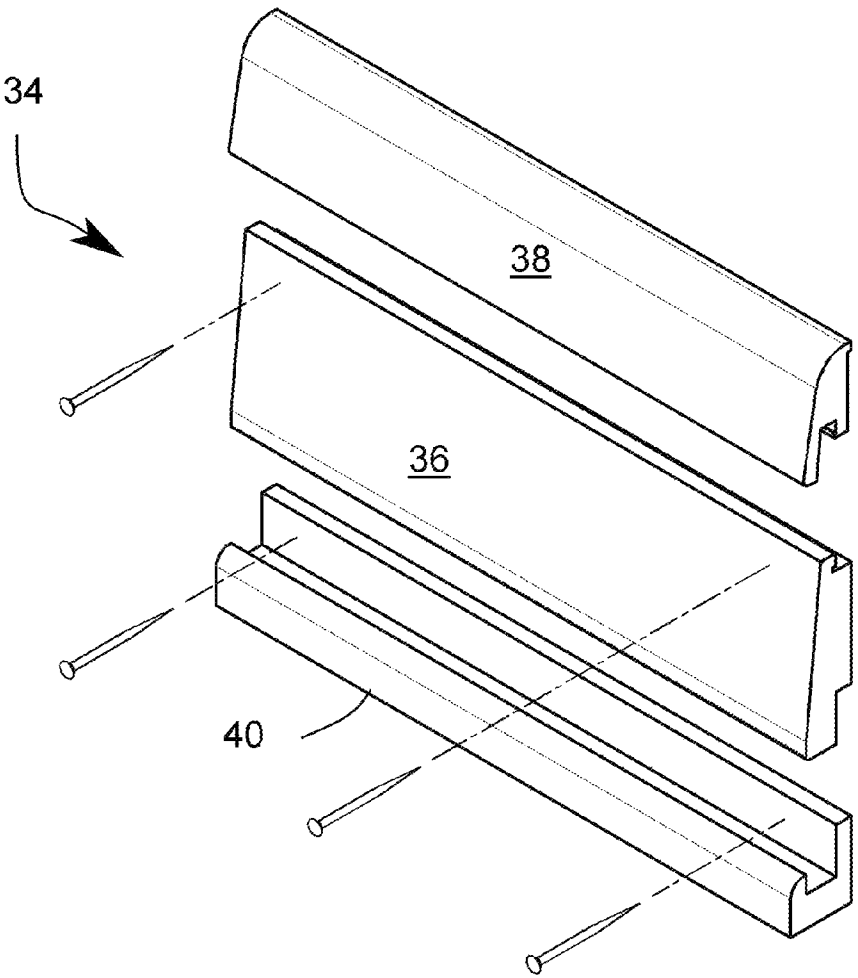
Figure 5:
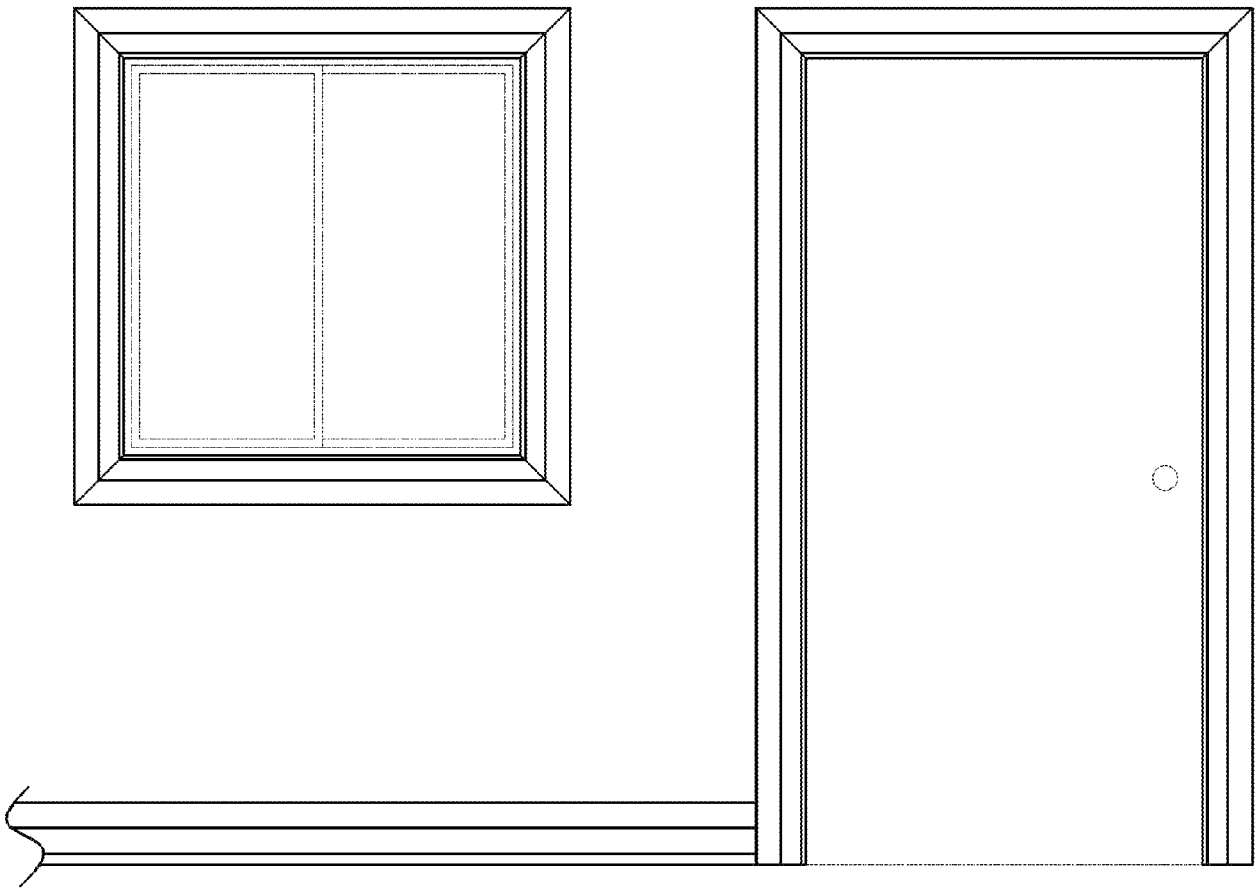
FIG. 5 Front view of the invention in context.
Figure 6:
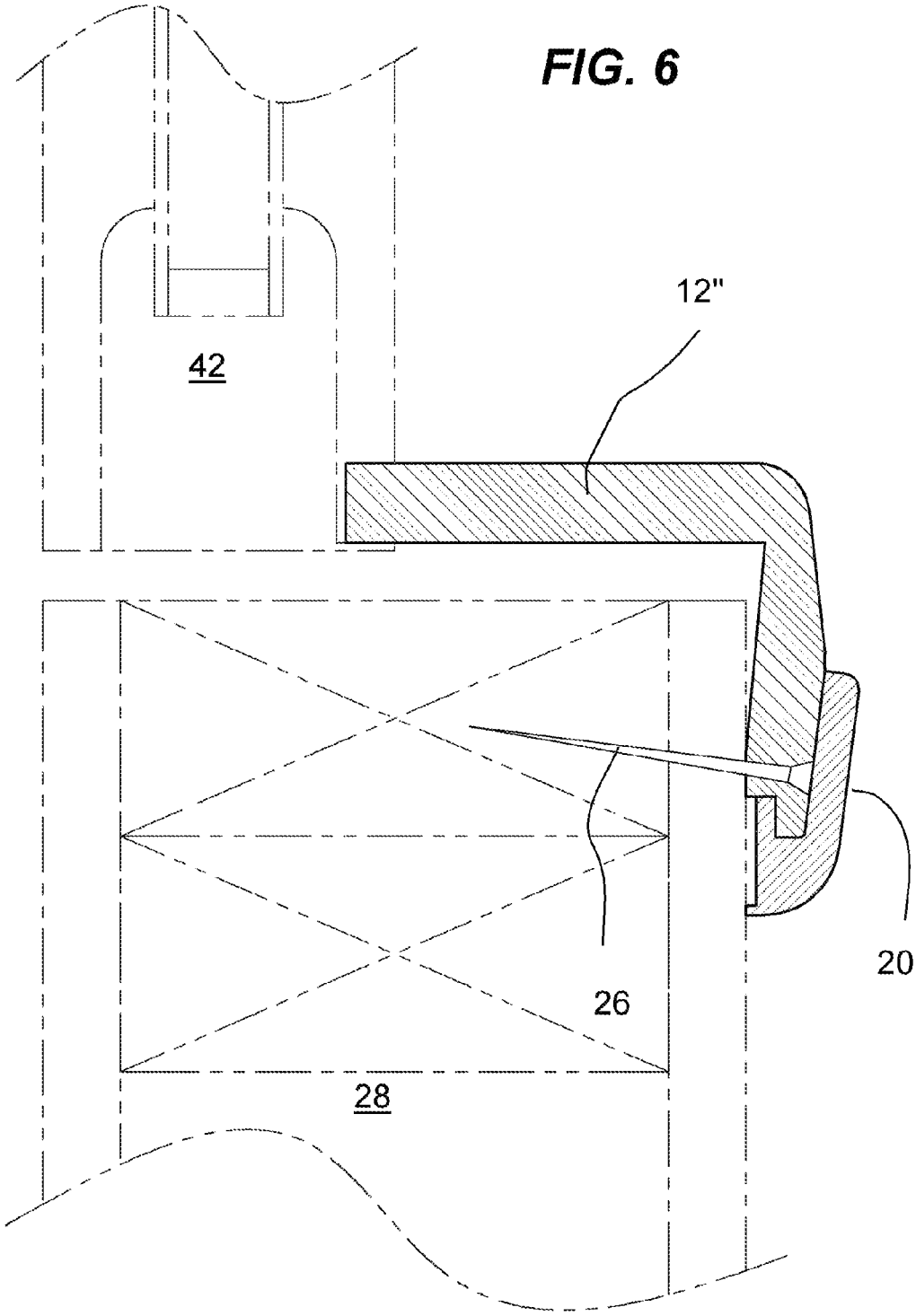
FIG. 6 Cutaway top view of the variant for a window.

A jamb and frame combination (10) has an elongated jamb member (12), a first frame member (14) and a second frame member (16).

The first frame member (14) has a first trim member (18), and the second frame member (16) has a second trim member (20).

The elongated jamb member (12) is configured and shaped like typical jamb members except for a pair of tongues (22) which run along the length of both sides of the elongated jamb member (12) and are configured and sized to cooperate with grooves (24) located on both the first and second frame members (14,16).

In order to secure the first and second frame members (14,16), a series of mechanical fasteners (26) pass through the first and second frame members (14,16). to attach to the casing (28). The trim members (18, 20) then cover the mechanical fasteners (26) by being frictionally attached to the frame members (14, 16). The second trim member (20) uses a tongue and groove arrangement (30), while the first trim member (18) uses a resiliently deformable arrangement (32).

In an alternate embodiment, a modified jamb member (12') includes both frame members in a "U" shape configuration. The trim members (18, 20) are the same though.

In yet another variation, the jamb member (12) can be laid flat so as to be used as a baseboard (34) having a main section (36), a top section (38) and a bottom section (40). The attachment means being similar to that discussed hereinabove.

In still another variation a modified window jamb (12") having an L-shaped cross section member that is configured for fitting around a window (42).

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A jamb and frame combination for window or door casings, comprising an elongated jamb member formed to fit snugly against the interior surface of a window or door casing, and having a tongue portion on each opposite side extending the length thereof; a first frame member formed to fit snugly against a respective inner or outer surface of said window or door casing, wherein said first frame member includes a groove portion extending the length thereof on one distal end that is snugly receives and mates with a respective tongue portion of said jamb member, and includes a tongue portion extending the lengths thereof on an opposite distal end that snugly receives and mates with a respective grooves of a trim member, and at least one removable fastener passing through said respective frame member in an area adjacent to each said tongue portion and passing into said window or door casing to thereby hold said first frame member snugly thereto; an elongated first trim member including a groove portion extending the length thereof and interlocking with said tongue portion of said first frame member, such that when said first frame members is installed upon a window or door casing, said first trim member groove portion is pushed upon said first frame member tongue portion and frictionally held in place and covering said at least one removable fastener; a second frame member formed to fit snugly against an opposite inner or outer surface of said window or door casing, wherein said second frame member includes a groove portion extending the length thereof on one distal end that snugly receives and mates with the opposite respective tongue portion of said jamb member, and includes a second groove portion extending the length thereof on an outside surface, and at least one removable fastener passing through said second frame member at a point that is within said second groove portion and passing into said window or door casing to thereby hold said second frame member snugly thereto; and an elongated second trim member snugly fitting within and covering said second groove portion and said at least one removable fastener; wherein said first frame member, said second frame member, and said jamb member together form a shape having a cross-section that includes an interior portion that flares in a direction along the widths of said first and second frame members, such that said first and second frame members can connect with a portion of said window or door casing without contacting the distal edge portions of said window or door casing.

2. The combination of claim 1, wherein each of said at least one removable fasteners for each respective frame member includes a series of removable fasteners extending the length of each said respective frame member.

3. The combination of claim 1, wherein said first frame member and said first trim member have interdigitating shapes, such that said first trim member fits snugly around the tongue portion and a front surface of said first frame member, thereby covering said at least one removable fastener.

4. The combination of claim 1, wherein said second trim member includes two deformable arms extending the length thereof, and are adapted to be pushed into and deformed within said second groove portion to thereby create a strong friction hold between said second trim member and said second groove portion.

* * * * *